US009115518B2

(12) United States Patent
Herglotz et al.

(10) Patent No.: US 9,115,518 B2
(45) Date of Patent: Aug. 25, 2015

(54) DEVICE FOR TRANSMITTING ELECTRICAL ENERGY FROM A WALL TO A SWIVELLABLE ELEMENT FASTENED ON THE WALL

(71) Applicant: DR. HAHN GMBH & CO. KG, Moenchengladbach-Wickrath (DE)

(72) Inventors: Tibor Herglotz, Kreuzau (DE); Ingo Steinfeld, Langenfeld (DE)

(73) Assignee: DR. HAHN GMBH & CO. KG, Moenchengladbach-Wickrath (DE)

( * ) Notice: Subject to any disclaimer, the term of this patent is extended or adjusted under 35 U.S.C. 154(b) by 0 days.

(21) Appl. No.: 14/367,240

(22) PCT Filed: Dec. 11, 2012

(86) PCT No.: PCT/EP2012/075070

§ 371 (c)(1),
(2) Date: Jun. 20, 2014

(87) PCT Pub. No.: WO2013/092297

PCT Pub. Date: Jun. 27, 2013

(65) Prior Publication Data

US 2014/0345084 A1 Nov. 27, 2014

(30) Foreign Application Priority Data

Dec. 23, 2011 (DE) ..... 20 2011 052 457 U

(51) Int. Cl.
*E05D 11/00* (2006.01)
*E05D 7/00* (2006.01)

(52) U.S. Cl.
CPC ..... *E05D 7/00* (2013.01); *E05D 11/0081* (2013.01); *Y10T 16/522* (2015.01)

(58) Field of Classification Search
CPC .... E05D 11/00; E05D 11/0081; E05D 15/242
USPC ..... 16/223, 232, 235, 238, 243, 248, 277, 16/286, 304–305, 354, 386
See application file for complete search history.

(56) References Cited

U.S. PATENT DOCUMENTS 2,729,473 A * 1/1956 Warshawsky ..... 285/153.1
4,168,409 A * 9/1979 McNinch ..... 200/61.7

(Continued)

FOREIGN PATENT DOCUMENTS

DE 805 361 C 5/1951
DE 812 652 C 9/1951

(Continued)

*Primary Examiner* — Roberta Delisle
(74) *Attorney, Agent, or Firm* — Norman B. Thot

(57) ABSTRACT

A device for transmitting at least one of electrical energy and electrical signals from a wall to a swivellable element fastened on the wall so as to be hinged about a hinge axis includes a wall part fastened to the wall, a swivellable-element part fastened on the swivellable-element, and a displacement drive. The swivellable-element part comprises an energy and/or signal transmitter comprising a wall-transmitter part arranged in the wall part and a swivellable-element-transmitter part arranged in the swivellable-element part. At least one of the wall-transmitter part and the swivellable-element-transmitter part are arranged so as to be displaceable in a direction of the hinge axis. The displacement drive is selectively actuatable. The displacement drive is operatively connected to at least one of the wall-transmitter part and a swivellable-element-transmitter part.

23 Claims, 8 Drawing Sheets

(56) References Cited

U.S. PATENT DOCUMENTS

| | | | | | |
|---|---|---|---|---|---|
| 4,412,711 | A | * | 11/1983 | Suska | 439/31 |
| 5,141,446 | A | * | 8/1992 | Ozouf et al. | 439/165 |
| 5,586,895 | A | * | 12/1996 | Zehrung | 439/165 |
| 6,618,902 | B2 | * | 9/2003 | Wu | 16/298 |
| 8,448,382 | B2 | * | 5/2013 | Rodgers et al. | 49/167 |
| 8,490,249 | B2 | * | 7/2013 | Boegel-Poetter et al. | 16/386 |
| 8,650,714 | B2 | * | 2/2014 | Staude | 16/386 |
| 2011/0041288 | A1 | * | 2/2011 | Pacini | 16/244 |
| 2012/0017396 | A1 | | 1/2012 | Meyer | |
| 2012/0242165 | A1 | | 9/2012 | Herglotz et al. | |

FOREIGN PATENT DOCUMENTS

| | | | |
|---|---|---|---|
| DE | 27 40 415 | A1 | 3/1979 |
| DE | 39 15 812 | A1 | 11/1990 |
| DE | 200 09 082 | U1 | 9/2001 |
| DE | 10 2004 017 341 | A1 | 1/2005 |
| DE | 20 2008 014 318 | U1 | 4/2010 |
| WO | WO 01/42603 | A1 | 6/2001 |
| WO | WO 2011/067010 | A2 | 6/2011 |

* cited by examiner

DEVICE FOR TRANSMITTING ELECTRICAL ENERGY FROM A WALL TO A SWIVELLABLE ELEMENT FASTENED ON THE WALL

CROSS REFERENCE TO PRIOR APPLICATIONS

This application is a U.S. National Phase application under 35 U.S.C. §371 of International Application No. PCT/EP2012/075070, filed on Dec. 11, 2012 and which claims benefit to German Patent Application No. 20 2011 052 457.4, filed on Dec. 23, 2011. The International Application was published in German on Jun. 27, 2013 as WO 2013/092297 A1 under PCT Article 21(2).

FIELD

The present invention relates to a device for transmitting electrical energy and/or electrical signals from a fixed wall to a swivellable element fastened on the wall so that it can be hinged about a hinge axis, having a hinge part, which can be fastened on the wall, having a swivellable-element part, which can be fastened on the swivellable element, having an energy and/or signal transmitter, which comprises a wall-transmitter part provided in the hinge part and a swivellable-element-transmitter part provided in the swivellable element, wherein at least one of the wall-transmitter part or swivellable-element-transmitter part is arranged so as to be displaceable in the direction of the hinge axis.

BACKGROUND

Hinges that are used for the hinged connection of a swivellable element to a wall have previously been described. They have proven to be of use in many cases in different technical embodiments and are also used with doors for objects such as houses, commercial properties, or also with escape doors.

Doors of this type increasingly have devices which improve safety or comfort and which are operated by means of electrical energy. These devices may comprise sensors, for example, glass break sensors, which transmit signals to a wall-side device, for example, an intruder alarm panel.

These devices are therefore usually connected for energy and/or signal transmission via flexible cables to an external energy source. These cable connections considerably impair the visual appearance and can become clamped between the swivellable element and the wall, which may lead to damage or even to destruction of the cables.

Bands having contactlessly operating energy and/or signal transmitters have previously been described in DE 39 15 812 A1 and DE 10 2004 017 341 A1. These are formed as concentrically arranged coils or as a cylindrical capacitor in DE 39 15 812 A1. In the case of DE 10 2004 017 341 A1, the contactlessly operating energy and/or signal transmitter comprises a first coil arranged in the frame hinge part and a second coil arranged in a swivellable-element hinge part. A hinge bolt passing through both coils magnetically couples the two coils, which are distanced from one another in the direction of the hinge axis.

The contactless energy transmission from a fixed frame into a swivellable element arranged pivotably on the frame is in principle possible with the devices described in the above-cited documents, however, tests have shown that the maximum transmittable powers are too low for many desirable fields of application since the power loss during the transmission is very high.

A generic device is described in WO 2011/067010 A2. In order to increase the transmittable power, the wall and swivellable-element-transmitter parts, which comprise induction coil arrangements, are mounted in the case of this device in the wall part or swivellable-element part so as to be displaceable in the direction of the hinge axis. Spring arrangements are provided both in the wall part and in the swivellable-element part, and the wall-transmitter part and swivellable-element-transmitter part can be pressed against one another by means of said spring arrangements. This measure ensures that the end faces, facing one another, of the two coils are always in direct contact with one another. This is of particular importance since, in particular with inductively acting energy and/or signal transmitters, the power loss rises sharply with an increase of the distance between the wall and swivellable-element-transmitter parts.

It has, however, been found that the mounting of a device of this type is significantly impaired, in particular if no hinge bolt defining the hinge axis is provided and the device serves merely to transmit electrical energy and/or electrical signals and not mechanical forces. The abutment of the wall and swivellable-element-transmitter parts against one another under the spring force additionally causes wear of the two sides of the swivellable-element and wall-transmitter parts sliding over one another during the opening and closing of the swivellable element.

SUMMARY

An aspect of the present invention is to improve the generic device in terms of mounting and functionality.

In an embodiment, the present invention provides a device for transmitting at least one of electrical energy and electrical signals from a wall to a swivellable element fastened on the wall and configured so as to be hinged about a hinge axis which includes a wall part configured to be fastened to the wall, a swivellable-element part configured to be fastened on the swivellable-element, and a displacement drive. The swivellable-element part comprises an energy and/or signal transmitter comprising a wall-transmitter part arranged in the wall part and a swivellable-element-transmitter part arranged in the swivellable-element part. At least one of the wall-transmitter part and the swivellable-element-transmitter part are arranged so as to be displaceable in a direction of the hinge axis. The displacement drive is configured to be selectively actuatable. The displacement drive is operatively connected to at least one of the wall-transmitter part and a swivellable-element-transmitter part.

BRIEF DESCRIPTION OF THE DRAWINGS

The present invention is described in greater detail below on the basis of embodiments and of the drawings in which.

DETAILED DESCRIPTION

Figure 2:
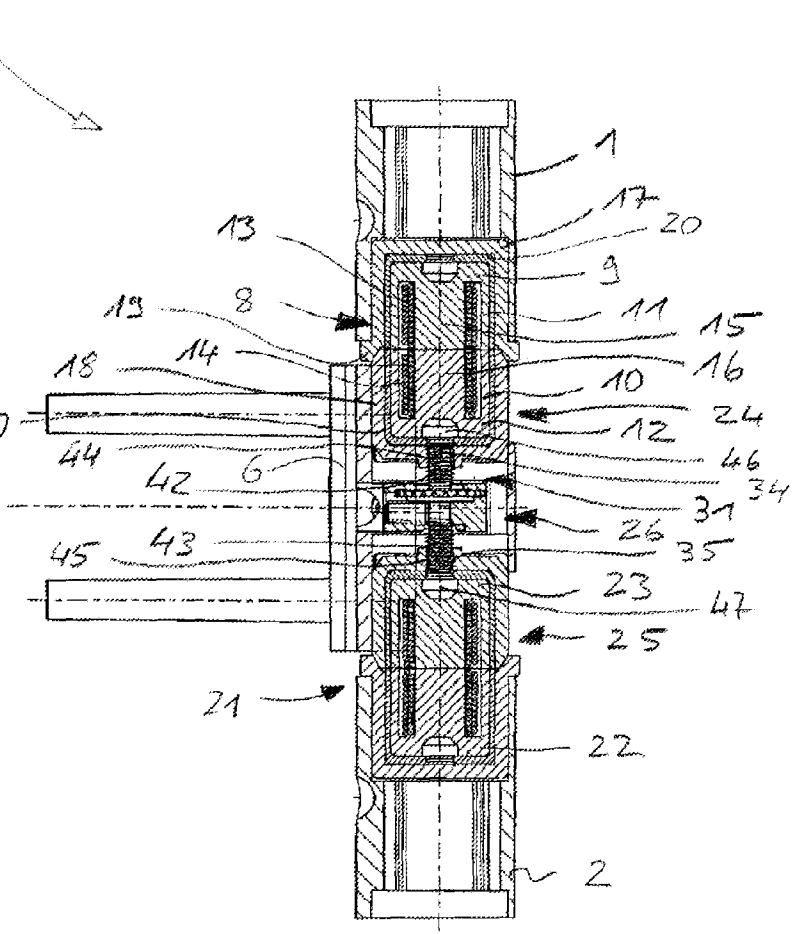
FIG. 2 shows the same exemplary embodiment in longitudinal section through the hinge axis.
Figure 1:
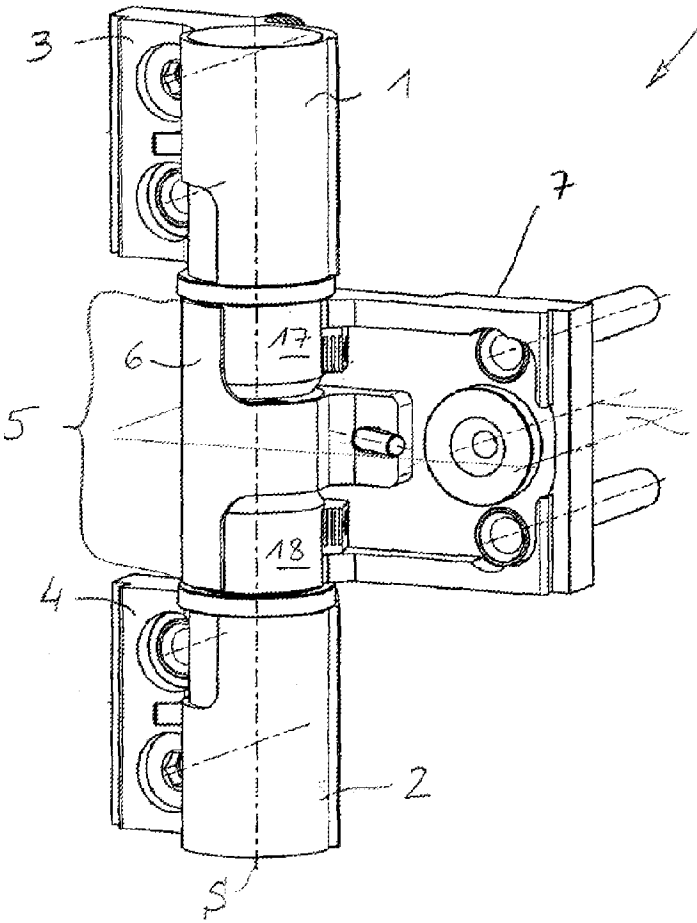
FIG. 1 shows a perspective view of an exemplary embodiment of a device according to the present invention with energy and signal transmitters in operational positions.

In an embodiment, the device according to the present invention comprises a selectively actuatable displacement drive, by means of which the wall-transmitter part and/or swivellable-element-transmitter part of the energy and/or signal transmitter can be displaced in the direction of the hinge axis S. This embodiment provides that the wall-transmitter part and/or swivellable-element-transmitter part can be brought with the aid of the displacement drive into a position in which a joining together of the device is possible. The displacement drive prevents the transmitter parts, as in the prior art, from being displaced in an uncontrolled manner in the direction of the hinge axis due to the spring force. In order to mount the device, the wall-transmitter part and/or swivellable-element-transmitter part can rather be displaced into retracted mounting positions and can then be displaced toward one another with the aid of the displacement drive when the device is joined together into positions in which their sides facing one another are arranged at a very short although clearly defined distance from one another, and in which the sides do not rub against one another under the action of spring elements. In order to attain the advantages associated with the present invention, it is not necessary for both the wall-transmitter part and the swivellable-element-transmitter part of an energy and/or signal transmitter to be arranged so as to be displaceable with the aid of the displacement drive in the direction of the hinge axis S. It is rather sufficient, due to the lower structural complexity, for example, to operatively connect either the wall-transmitter part or the swivellable-element-transmitter part to the displacement drive and to arrange the other part fixedly in the wall part or swivellable-element part, respectively.

In an embodiment of the present invention, the displacement drive can, for example, comprise an adjusting spindle, for example, mounted rotatably about the hinge axis. The adjusting spindle can then be arranged, for example, so that the axis of rotation thereof coincides approximately with the hinge axis.

In an embodiment of the present invention, the adjusting spindle can, for example, be arranged so as to be stationary in the direction of the hinge axis. It therefore does not move relative to the wall part and swivellable-element part upon actuation, but instead the wall-transmitter part and/or swivellable-element-transmitter part move/moves relative to the adjusting spindle in the direction of the hinge axis in the event of rotary actuation.

To this end, the adjusting spindle can, for example, be engaged with a spindle nut provided on the at least one wall-transmitter part or swivellable-element-transmitter part or connected thereto.

In an embodiment of the present invention, the adjusting spindle can be formed so as to be double-acting, i.e., the adjusting spindle may comprise a right-hand thread in one region and a left-hand thread in another region. This embodiment is in particular suitable for use in a device according to the present invention which, for example, has the form of a three-part hinge. A hinge of this type has two wall parts distanced from one another in the hinge axis direction and a swivellable-element part engaging in the spacing gap between the two wall parts. A device of this type is in particular suitable for accommodating two transmitters each having a wall-transmitter part and a swivellable-element-transmitter part. One of the transmitters may then serve to transmit electrical energy, whereas the other transmitter serves to transmit electrical signals. The double-acting adjusting spindle can in this case be arranged within the swivellable-element part so as to be stationary in the direction of the hinge axis S and may cooperate via one region with the swivellable-element-transmitter part of the energy transmitter and via the other region with the swivellable-element-transmitter part of the signal transmitter. A rotary actuation of the adjusting spindle then causes the two swivellable-element-transmitter parts to move toward one another or away from one another depending on the direction of rotation.

In an embodiment of the present invention, the adjusting spindle can, for example, have a device for fitting a rotary actuation tool. To this end, it may have outer teeth, for example, to which a screwdriver blade serving as a rotary actuation tool can be fitted by way of example. A worm gear is alternatively engaged with the outer teeth, of which the axis of rotation runs perpendicularly to the hinge axis and which itself can be rotated using a rotary tool. This embodiment would be characterized by a more sensitive actuatability.

In an embodiment of the present invention, an adjusting wheel connected to the spindle can, for example, be provided, said wheel having crown gear teeth. These crown gear teeth may be formed so that they can be engaged, for example, with a commercially conventional polygonal rotary tool (for example, Torx®). This embodiment is characterized by a particularly sensitive adjustability without the need to provide gearing components for this purpose in the device, with the exception of the adjusting wheel. No extra auxiliary tool provided for the rotary actuation is additionally necessary since the teeth can, for example, be matched to a polygonal rotary tool, which is required in any case for the mounting of the device.

It is also possible to provide a drive device that is engaged with the crown gear teeth and is mounted in a spindle receptacle in which the adjusting spindle is provided. The drive device can be designed for actuation with the aid of a certain tool provided for this purpose or can be designed for manual actuation.

In an embodiment of the present invention, the drive device can, for example, comprise a shaft having outer teeth which are engaged with the crown gear teeth.

In an embodiment of the present invention, the drive device can, for example, additionally have a conical surface which cooperates with a locking surface provided on the spindle receptacle and provides that the drive device sits captively when received in the spindle receptacle.

A locking element for selectively locking the displacement drive can, for example, be provided so as to be able to permanently maintain a positioning of the transmitter parts attained with the aid of the displacement drive.

This locking element may comprise a stud bolt which can be tightened selectively with respect to the adjusting spindle.

Transmitters in a wide range of technical embodiments or acting technically in many different ways can in principle be used in conjunction with the device according to the present invention. It is thus also conceivable, for example, to use optoelectronically or capacitively acting transmitters and to be able to position these optimally due to the embodiment according to the present invention. The device according to the present invention is in particular intended for the use of induction coil arrangements with the wall-transmitter part and swivellable-element-transmitter part.

The wall-transmitter part and/or swivellable-element-transmitter part may comprise housings for shielding electric or magnetic fields, the housings being open on the sides of the wall-transmitter part and swivellable-element-transmitter part facing one another. In order to compensate for manufacturing tolerances autonomously, the actual transmitter parts can be mounted in a floating manner in the housings, for example, by means of a yielding layer in a gap between the transmitter component and the housing.

The device according to the present invention can, for example, additionally have means for preventing twisting of the wall-transmitter part or swivellable-element-transmitter part in the hinge part or swivellable-element part. Any driving forces produced between the wall-transmitter part and swivellable-element-transmitter part when the swivellable element is opened or closed, for example, as a result of infiltrated contaminations, are thus prevented from breaking any connection cables present of the transmitter parts.

The anti-twist means may comprise a protrusion provided on the wall-transmitter part or swivellable-element-transmitter part, the protrusion projecting into a recess provided on the wall part or swivellable-element part. This recess may comprise delimiting surfaces running approximately perpendicularly to the hinge axis and forming displacement path delimitations for the wall-transmitter part or swivellable-element-transmitter part.

The protrusion may have a channel for passing through connection cables of the wall-transmitter part or swivellable-element-transmitter part so as to thus produce particularly effective protection against connection cable damage.

The present invention will be explained in greater detail below on the basis of the accompanying drawings.

The exemplary embodiment of a device according to the present invention, denoted in the drawing on the whole by 100, is a copy of a three-part hinge. It comprises two wall parts 1, 2, which are distanced from one another in the direction of the hinge axis S and on which fastening parts 3, 4 are integrally formed.

A swivellable-element part 6 is arranged in the spacing gap 5 between the two wall parts 1, 2. The swivellable-element part 6 is pivotable about the hinge axis S. It comprises a fastening part 7, by means of which it can be fastened on a swivellable element (not illustrated in the drawing).

As can be seen in particular in FIG. 2, the device 100 comprises an energy transmitter 8, which in particular serves to transmit electrical actuating power from a wall into the swivellable element, which is required by loads provided on the swivellable element in order to drive the loads. The energy transmitter 8 comprises a wall-transmitter part 9 provided in the wall part 1 and a swivellable-element-transmitter part 10 provided in the swivellable-element part 6. The wall-transmitter part 9 and swivellable-element-transmitter part 10 are formed as induction coils for mutual inductive coupling. They each comprise a soft-magnetic coil former 11, 12, which is completely surrounded by a respective coil winding 13, 14, with the exception of sides facing one another. Both coil formers 11, 12 have a central core 15, 16, which are formed solidly in this exemplary embodiment of the device 100. The end faces of the coil formers 11, 12 facing one another, inclusive of the cores 15, 16, are flat.

With the exception of the ends facing one another, the coil formers 11, 12, and therefore the actual transmitter parts 9, 10 are surrounded by housings 17, 18, which serve to shield external interferences, in particular external magnetic fields in the illustrated exemplary embodiment. The housings 17, 18 are formed so that they overlap on the side facing one another by integrally formed, complementary chamfers. The housing 17 of the wall-transmitter part 9 to this end has a radially protruding peripheral collar 19, which immediately forms a contact surface for the purpose of positioning the housing 17 in the wall part 1.

A layer 20 made of a yielding material is provided between the housings 17, 18 and the respective coil formers 11, 12 and provides a type of floating mounting of the coil formers 11, 12. As a result, the two coil formers 11, 12 align themselves in the mounted state and bear against one another at least substantially other their entire area.

The device 100 according to the present invention, in addition to the energy transmitter 8, also has a signal transmitter 21, of which the basic structure corresponds to that of the energy transmitter 8. It accordingly also comprises a wall-transmitter part 22, which is provided in the second wall part 2. The swivellable-element-transmitter part 23 is in turn arranged in the swivellable-element part 6, but on the side pointing away from the swivellable-element-transmitter part 10 of the energy transmitter 8. With respect to the further construction of the wall-transmitter part 22 and swivellable-element-transmitter part 23 of the signal transmitter 21 and the arrangement thereof in the wall part 2 or the swivellable-element part 6, reference is made to the statements concerning the energy transmitter 8 to avoid repetition. The components of the energy transmitter 8 and those of the signal transmitter 21 can of course also be formed differently in terms of their electrical and electromagnetic properties and their dimensionings in order to adapt the two transmitters in the best possible way to the powers and/or signals to be transmitted.

In order to insert the swivellable-element part 6 preassembled with the swivellable-element-transmitter parts 10, 23 into the spacing gap 5 between the wall parts 1, 2, the swivellable-element-transmitter parts 10, 23 are arranged in the swivellable-element part 6 so as to be displaceable in the direction of the hinge axis S. To this end, recesses 24, 25 are provided in the swivellable-element part 6 and are adapted to the outer contours of the housings 17, 18 of the swivellable-element-transmitter parts 10, 23 so that these are received by the recesses substantially without lateral play.

Figure 5:
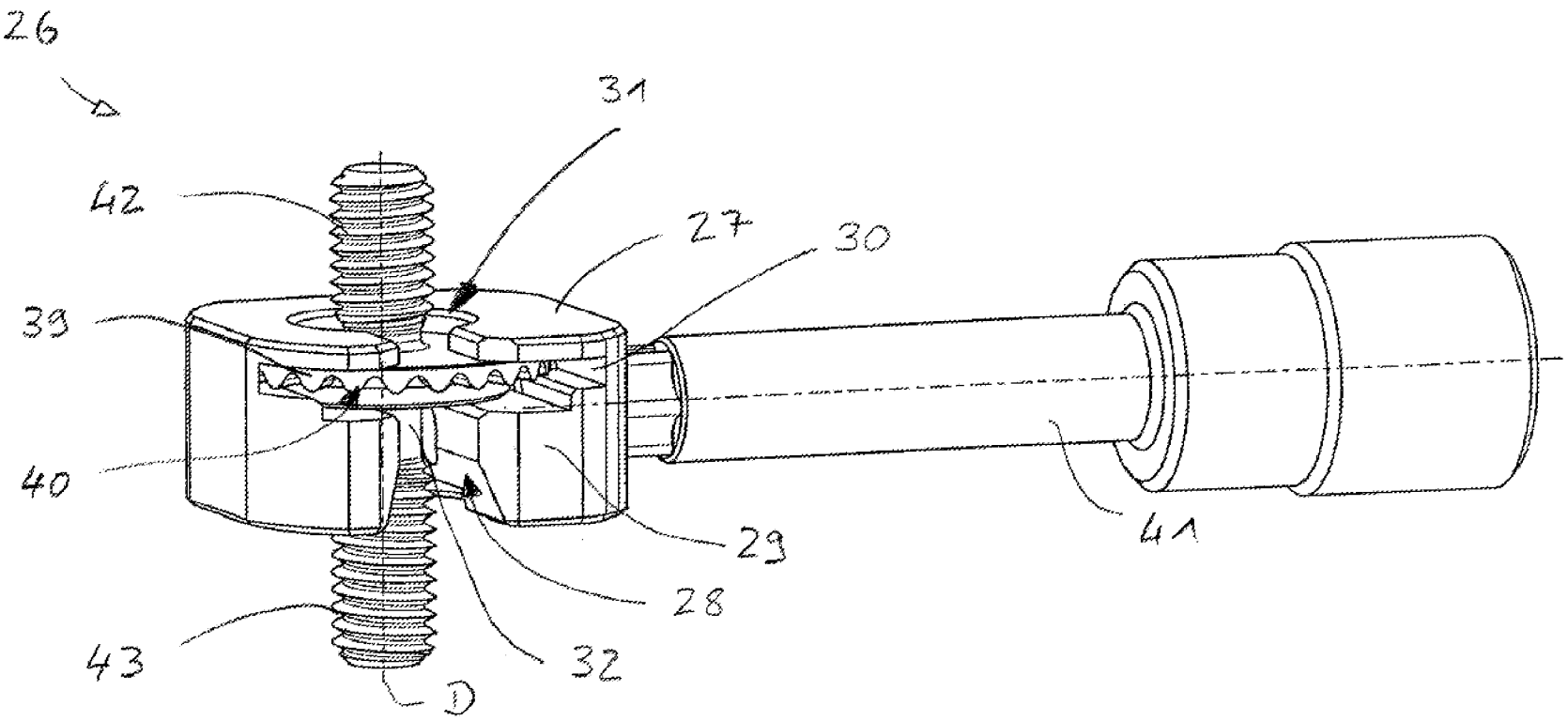
FIG. 5 shows the displacement drive with fitted rotary tool in an isolated illustration.

A displacement drive 26 is fixed between the two recesses 24, 25 in the direction of the hinge axis S. The displacement drive 26 is illustrated in FIG. 5 in an isolated illustration together with a rotary tool provided for actuation thereof. The displacement drive 26 comprises a spindle receptacle 27 which consists of a plastic molded part and has an opening 28 that is approximately keyhole-shaped in cross section and extends through the side wall 29 facing the viewer in FIG. 5. The opening 28 further comprises a laterally widening, approximately slotted region 30. The opening 28 serves to support an adjusting spindle 31, which comprises a central cylindrical region 32, which is mounted substantially without play within the opening 28. The contour of the keyhole-shaped opening 28 is matched to the outer diameter of the region 32 so that the adjusting spindle 31 can be clipped into the spindle receptacle 27 from the side wall 29 by overcoming a resilient force through the narrow region of the keyhole-shaped opening.

A radially outwardly protruding crown gear 39, which carries teeth 40 and is provided for the engagement of a polygonal rotary tool 41 that can be fitted optionally, is integrally formed on the region 32. In order to be able to fit this polygonal rotary tool 41, a bore is provided on the spindle receptacle 27 (not visible in FIG. 5). A partial length of this bore is provided with an outer thread into which a stud bolt 37 forming a locking element 36 can be screwed in order to selectively lock the adjusting spindle 31. In the fully screwed-in state, the stud bolt 37 presses against the adjusting spindle 31 via its end that is arranged at the front in the screw-in direction.

Threaded regions 42, 43 adjoin the region 32 of the adjusting spindle 31 in the direction of the axis of rotation D of the adjusting spindle 31. The outer thread of one threaded region is formed as a right-hand thread, the outer thread of the other threaded region is formed as a left-hand thread. The adjusting spindle 31, as can be seen in particular in FIG. 2, engages by means of these threaded regions in complementary threaded bores 44, 45, which serve as spindle nuts 34, 35, of the housing of the swivellable-element-transmitter parts 10, 23, so that these are moved toward one another or away from one another as a result of rotary actuation of the adjusting spindle 31, depending on the direction of rotation. In order to avoid a delimitation of the displacement path as a result of an abutment of the end-face ends of the threaded regions 42, 43 against coil formers of the swivellable-element-transmitter parts, blind bores 46, 47 are provided on the coil formers, into which bores parts of the threaded regions 42, 43 can protrude. Blind bores of this type are also provided in the coil formers of the wall-transmitter parts (but have no function in this case) so that the same coil formers can be used in order to reduce manufacturing costs thereof.

Figure 3:
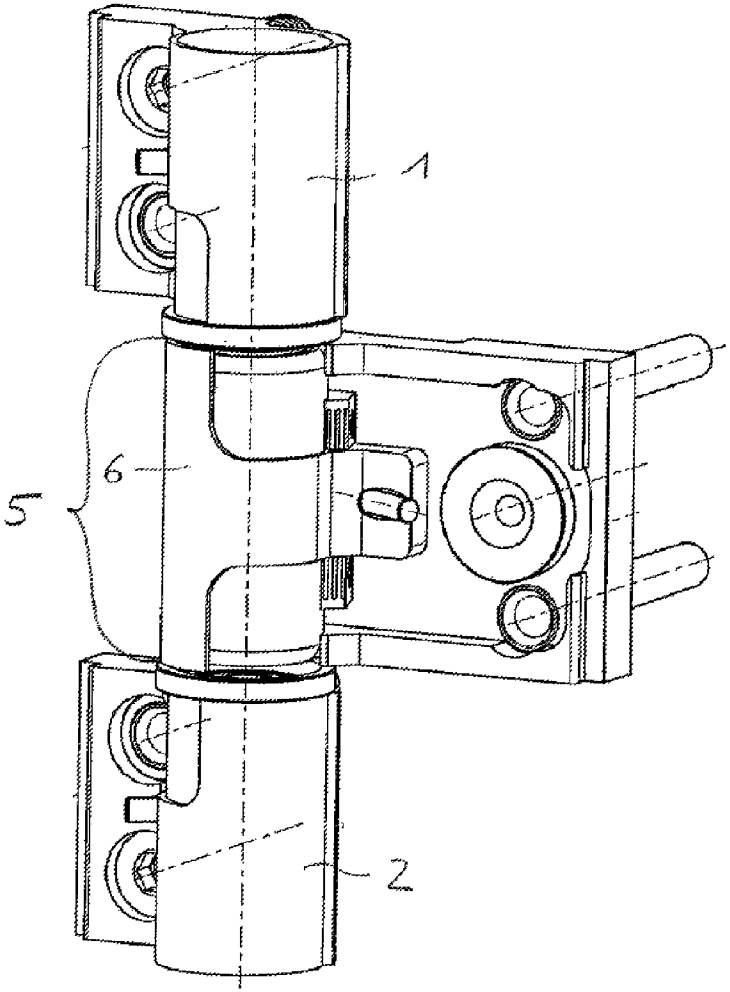
FIG. 3 shows the same exemplary embodiment in a view corresponding to FIG. 1, but with energy and signal transmitters in a mounting position.

As is expedient in particular from FIG. 2, the two swivellable-element-transmitter parts 10, 23 can be moved toward one another by rotary actuation of the adjusting spindle 31 with the aid of a rotary tool, such that, as is illustrated in FIG. 3, they can be retracted into the spacing gap 5 between the hinge parts 1, 2, so that the swivellable-element part 6 can be displaced out from the spacing gap 5.

Figure 4:
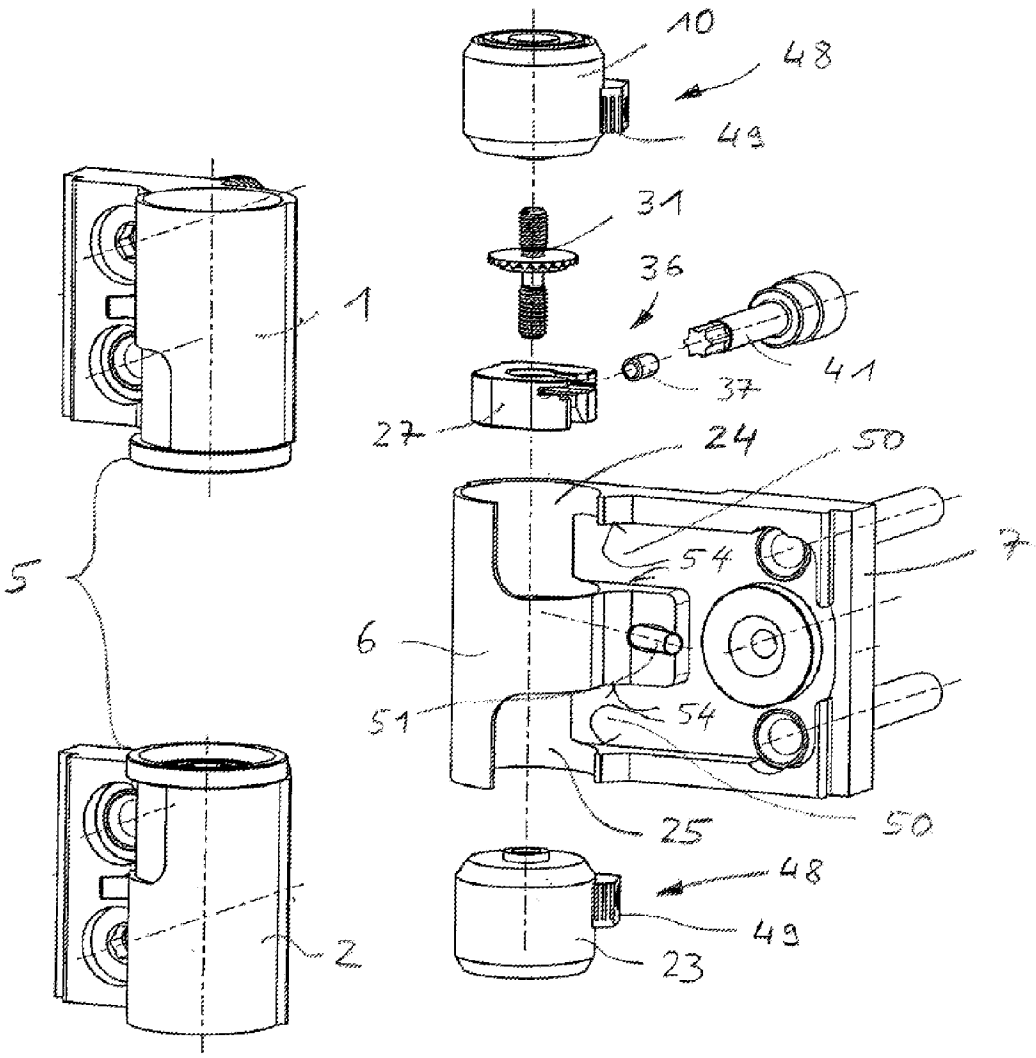
FIG. 4 shows the same exemplary embodiment in a view corresponding to FIGS. 1 and 3, but with the swivellable-element part in an exploded illustration.
Figure 7:
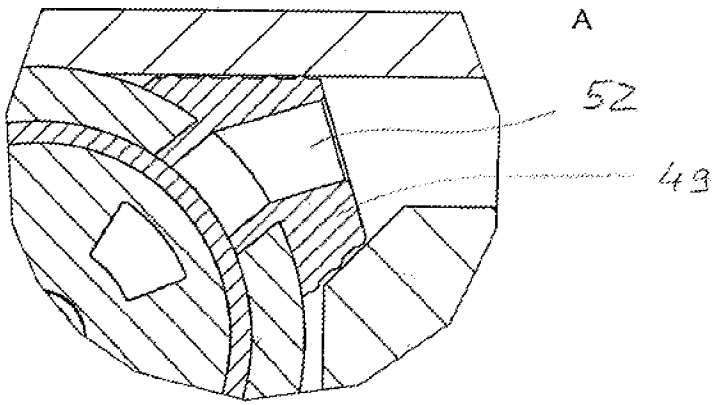
FIG. 7 shows detail A in FIG. 6 in an enlarged illustration.
Figure 6:
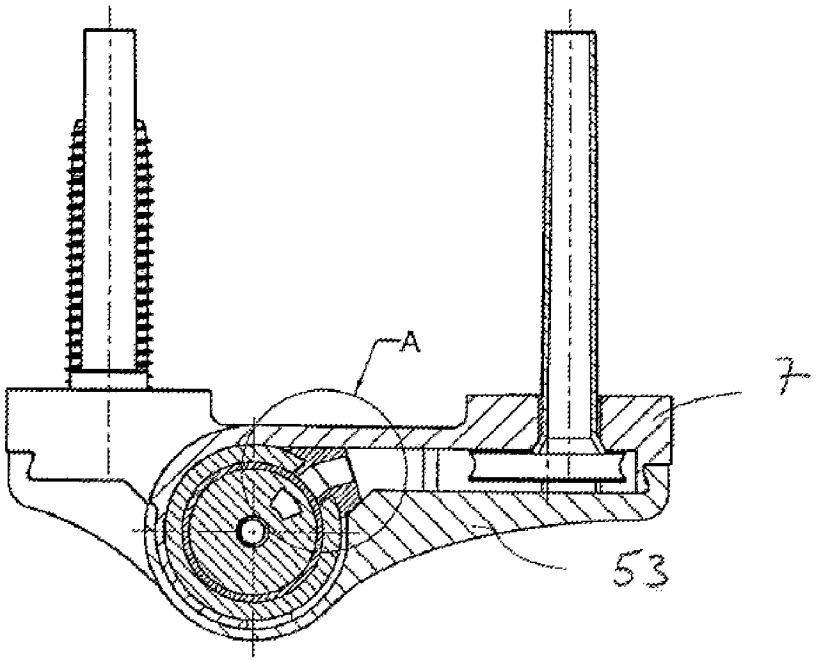
FIG. 6 shows a section along the plane of section VI in FIG. 1.

It is visible in particular in FIGS. 4, 6 and 7 that anti-twist means 48 in the form of protrusions 49 are provided on the swivellable-element-transmitter parts 10, 23. These protrusions 49 engage with indentations 50 in the fastening part 7, which are covered by a covering cap 53 when the device is fully assembled. This covering cap 53 is secured with the aid of a retaining screw 51. The indentations 50 comprise delimitation surfaces 54 running approximately perpendicularly to the hinge axis S and forming adjustment paths for the wall-transmitter part or the swivellable-element-transmitter part.

As can be seen in particular in FIG. 7, each protrusion 49 has a channel 52, through which connection cables (not visible in the drawing) of the respective swivellable-element-transmitter part can be guided in a protected manner.

The frame transmitter parts may also have anti-twist means formed accordingly.

Figure 9:
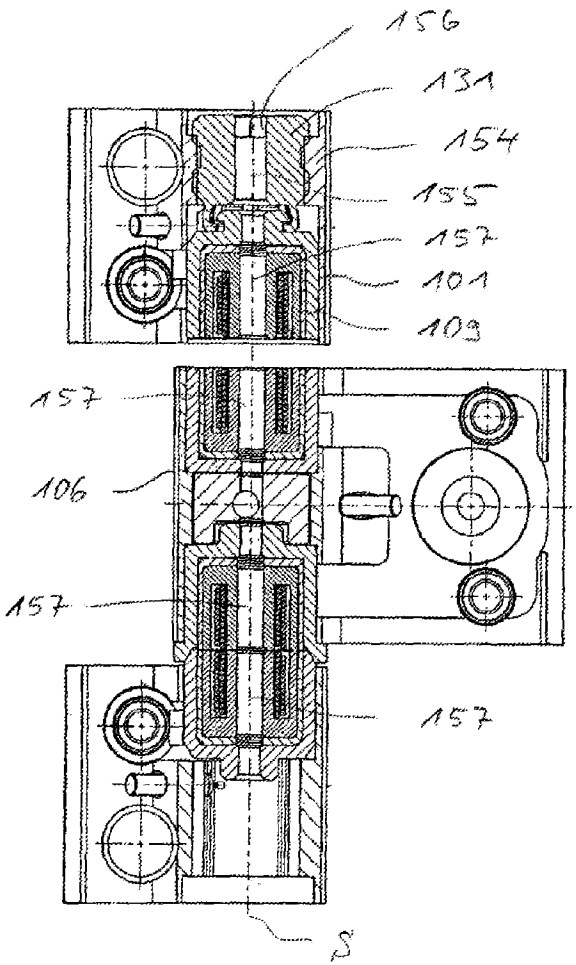
FIG. 9 shows the same exemplary embodiment as in FIG. 8 in a corresponding view, but with energy and signal transmitters in a mounting position.
Figure 8:
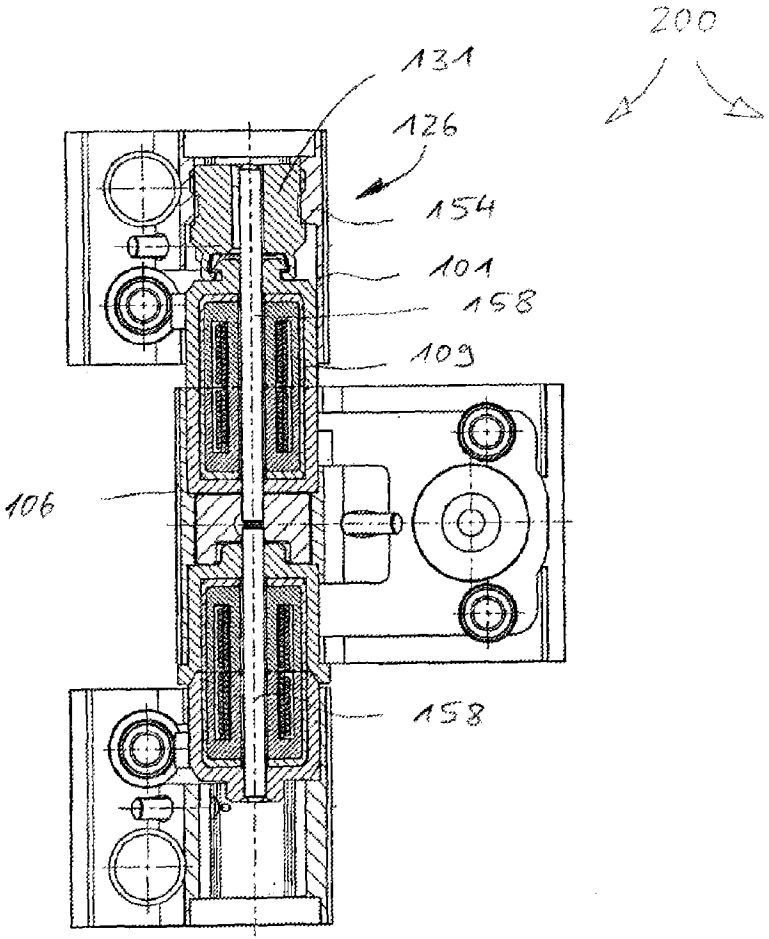
FIG. 8 shows an exemplary embodiment of a device according to the present invention in a longitudinal section through the hinge axis with energy and signal transmitters in operational positions.

A further exemplary embodiment 200 of a device according to the present invention is illustrated in FIGS. 8 and 9. For the purpose of avoiding repetitions, merely the differences from the exemplary embodiment 100 will be discussed hereinafter. Reference is made to the full scope of the description of the exemplary embodiment 100 unless contradicted by the explanations below.

In the exemplary embodiment 200, the displacement drive 126 is provided in the upper wall part 101. It comprises an adjusting spindle 131, which is screwed into a threaded receptacle 154 within the wall part 101. The adjusting spindle 131 has a central continuous bore 155, at the upper end of which a polygonal recess 156 for fitting a rotary tool is provided.

The wall-transmitter part 109, which is arranged within the wall part 101 so as to be displaceable in the direction of the hinge axis S, is connected in a form-fitting manner to the adjusting spindle 131 in the direction of the hinge axis S. By means of rotary actuation of the adjusting spindle 131, the wall-transmitter part 109 can thus be displaced between the operating position illustrated in FIG. 8 and the mounting position illustrated in FIG. 9, whereby the swivellable-element part 106 can be mounted and dismounted in a simple manner.

The exemplary embodiment 200 differs from the previously described exemplary embodiment 100 in that all coil formers comprise a central longitudinal bore 157. A hinge bolt 158 formed in one part or a number of parts can be introduced into said bore and aligns the transmitter parts with respect to one another.

Figure 11:
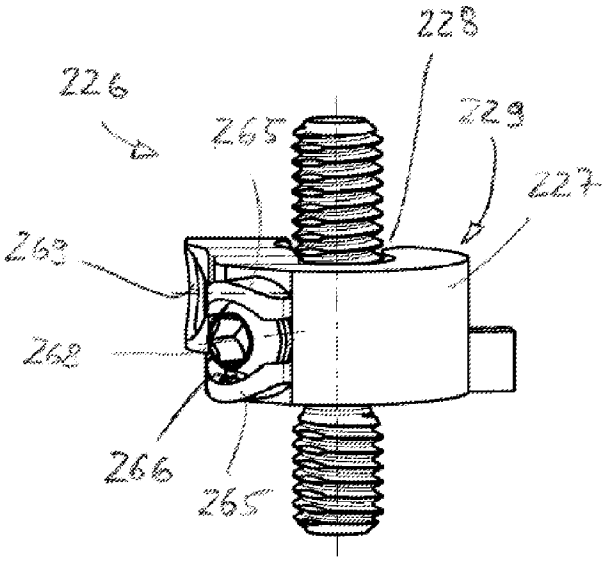
FIG. 11 shows the displacement drive of this exemplary embodiment of FIG. 10 in an isolated illustration.
Figure 10:
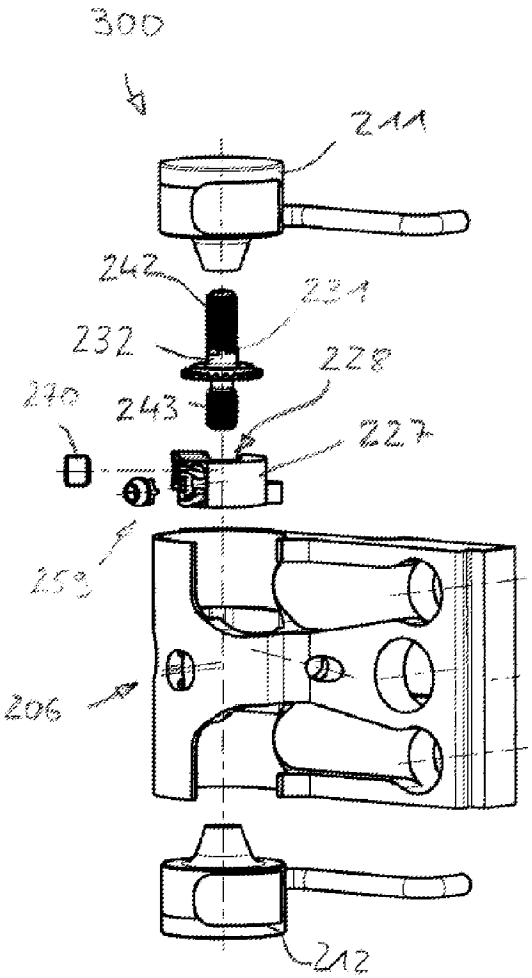
FIG. 10 shows the swivellable-element part of an exemplary embodiment of a device according to the present invention in a perspective exploded illustration.
Figure 12:
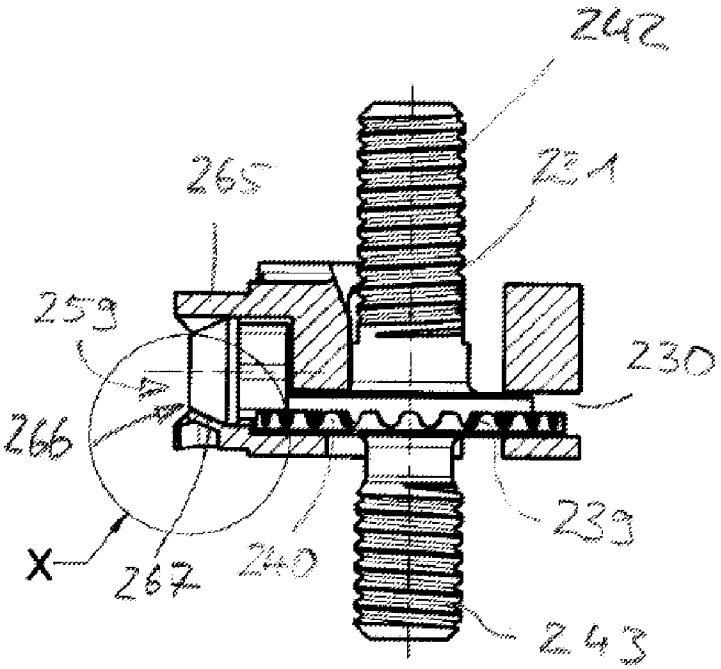
FIG. 12 shows the displacement drive according to FIG. 11 in a partly sectional illustration.

In a further embodiment 300 illustrated in FIG. 10, of which merely the swivellable-element part is reproduced in an exploded illustration, the displacement drive 226 in turn has a spindle receptacle 227, which, for example, may consist of a metal molded part. The spindle receptacle 227, similarly to the spindle receptacle 27 in exemplary embodiment 100, has an opening 228 that is approximately keyhole-shaped in cross section and that extends through the side wall 229 facing away from the viewer in FIG. 11. The opening 228 again comprises an approximately slotted region 230 that widens laterally (see FIG. 12 in particular).

The opening 228 serves to support the adjusting spindle 231. It comprises a central cylindrical region 232 which is mounted within the opening 228 substantially without play.

The contour of the keyhole-shaped opening 228 is adapted to the outer diameter of the region 232 so that the adjusting spindle 231 can be introduced from the side wall 229 through the narrow region of the keyhole-shaped opening into the spindle receptacle 227, and can, for example, be clipped thereinto.

Figure 13:
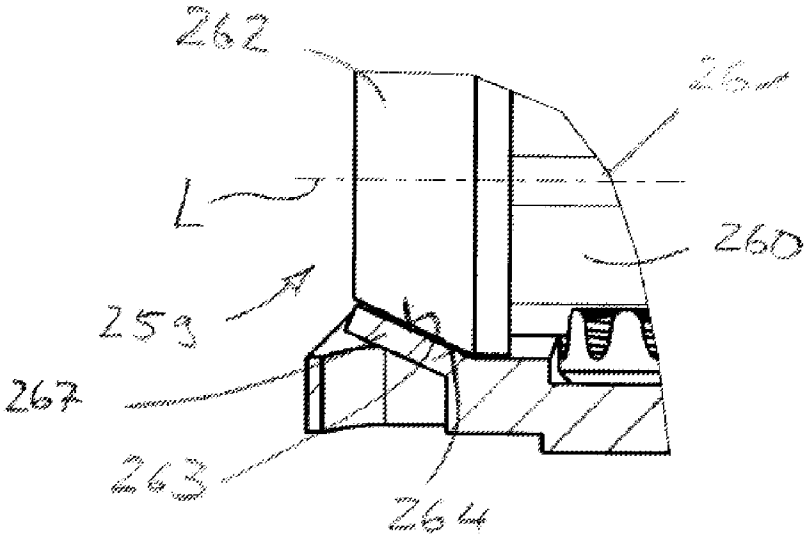
FIG. 13 shows detail X in FIG. 12 in an enlarged illustration.

An outwardly protruding crown gear 239, which carries teeth 240, is integrally formed on the region 232. As can be seen in particular in FIGS. 12 and 13, it is intended for the engagement of a drive device 259. It comprises a cylindrical shaft 260, which comprises outer teeth 261, which mesh with the teeth 240 of the crown gear 239.

A head 262 adjoins the shaft 260 outwardly and has an outwardly conically tapering shape. The conical surface 263 of the head bears against a locking surface 264 of the head 262, so that the drive device 259 is mounted rotatably about its longitudinal axis L, but is mounted in the spindle receptacle 227 substantially without play in the direction of the longitudinal axis L.

The locking surface 264 is formed by a tab 267 provided on the lower two protrusions 265. The two protrusions 265 delimit a receiving opening 266, in which the drive device 259 is mounted. The tab 267 is initially located in a position protruding approximately perpendicularly from the side wall of the spindle receptacle, before the spindle receptacle 227 is fitted with the drive device 259. Once the spindle receptacle 227 has been fitted with the drive device 259, the tab 267 is bent plastically so that it bears against the conical surface 263 of the drive device 259.

To fit a rotary tool, the drive device 259 has an internal hex 268. Of course, other means such as slots, cross recesses, etc. can be used to fit a rotary tool.

The spindle receptacle 227 further comprises a threaded bore 269 which is offset from the receiving opening 266. The threaded bore 269 serves to receive a stud bolt 270, which is rotatable against the region 232 of the adjusting spindle 231 so as to lock this in a desired position against independent twisting.

The adjusting spindle 231 engages via its threaded regions 242, 243 with bores of coil formers 211, 212. The threaded regions have threads running in opposite directions, that is to say a left-hand and a right-hand thread, such that, with rotary actuation of the adjusting spindle 231, the two coil formers are moved away from one another or toward one another depending on the direction of rotation.

The present invention is not limited to embodiments described herein; reference should be had to the appended claims.

LIST OF REFERENCE NUMERALS

100, 200, 300 device
1, 101 wall part
2 wall part
3 fastening part
4 fastening part
5 spacing gap
6, 106, 206 swivellable-element part
7 fastening part
8 energy transmitter
9, 109 wall-transmitter part
10 swivellable-element-transmitter part
11, 211 coil former
12, 212 coil former
13 coil winding
14 coil winding
15 core
16 core
17 housing
18 housing
19 peripheral collar
20 layer
21 signal transmitter
22 wall-transmitter part
23 swivellable-element-transmitter part
24 recess
25 recess
26, 126, 226 displacement drive
27, 227 spindle receptacle
28, 228 opening
29, 229 side wall
30, 230 region
31, 131, 231 adjusting spindle
32, 232 region
34 spindle nut
35 spindle nut
36 locking element
37 stud bolt
39, 239 crown gear
40, 240 teeth
41 polygonal rotary tool
42, 242 threaded region
43, 243 threaded region
44 threaded bore
45 threaded bore
46 blind bore
47 blind bore
48 anti-twist means
49 protrusions
50 indentations
51 retaining screw
52 channel
53 covering cap
54 delimitation surfaces
154 threaded receptacle
155 continuous bore
156 polygonal recess
157 longitudinal bore
158 hinge bolt
259 drive device
260 shaft
261 outer teeth
262 head
263 conical surface
264 locking surface
265 protrusions
266 receiving opening
267 tab
268 internal hex
269 threaded bore
270 stud bolt
D axis of rotation
L longitudinal axis
S hinge axis

What is claimed is:

1. A device for transmitting at least one of electrical energy and electrical signals from a wall to a swivellable element fastened on the wall and configured so as to be hinged about a hinge axis, the device comprising:

a wall part configured to be fastened to the wall;

a swivellable-element part configured to be fastened on the swivellable-element, the swivellable-element part comprising an energy and/or signal transmitter comprising a wall-transmitter part arranged in the wall part and a swivellable-element-transmitter part arranged in the swivellable-element part, at least one of the wall-transmitter part and the swivellable-element-transmitter part being arranged so as to be displaceable in a direction of the hinge axis; and a displacement drive configured to be selectively actuatable, the displacement drive being configured to displace at least one of the wall-transmitter part and a swivellable-element-transmitter part between a retracted mounting position and an extended operational position.

2. The device as recited in claim 1, wherein the displacement drive comprises an adjusting spindle.

3. The device as recited in claim 2, wherein the adjusting spindle is mounted so as to rotate about the hinge axis.

4. The device as recited in claim 2, wherein the adjusting spindle is arranged so as to be mechanically fixed in the hinge axis.

5. The device as recited in claim 2, further comprising a spindle nut arranged on or connected to the wall-transmitter part or arranged on or connected to the swivellable-element-transmitter part, wherein the spindle nut is configured to engage the adjusting spindle.

6. The device as recited in claim 2, wherein the adjusting spindle comprises a first threaded region comprising a right-hand thread and a second threaded region comprising a left-hand thread.

7. The device as recited in claim 2, wherein the adjusting spindle comprises a mechanism for fitting a rotary actuation tool.

8. The device as recited in claim 7, wherein the mechanism comprises outer teeth.

9. The device as recited in claim 7, wherein the mechanism comprises crown gear teeth.

10. The device as recited in claim 9, wherein the adjusting spindle further comprises a crown gear, wherein the crown gear teeth are arranged on the crown gear.

11. The device as recited in claim 2, further comprising a spindle receptacle configured to have the adjusting spindle arranged therein, and a drive device configured to actuate the adjusting spindle arranged in the spindle receptacle.

12. The device as recited in claim 11, wherein the drive device comprises a shaft comprising outer teeth.

13. The device as recited in claim 12, wherein the drive device further comprises a conical surface, the spindle receptacle comprises a locking surface, and the conical surface is configured to cooperate with the locking surface.

14. The device as recited in one of claim 2, further comprising a locking element configured to selectively lock the displacement drive.

15. The device as recited in claim 14, wherein the locking element comprises a stud bolt configured to be selectively tightened with respect to the adjusting spindle.

16. The device as recited in claim 1, wherein the displacement drive is arranged in the at least one swivellable-element part.

17. The device as recited in claim 16, wherein the device further comprises;

two swivellable-element-transmitter parts;

a spindle nut arranged on or connected to each of the two swivellable-element-transmitter parts; and a wall part arranged on either side of the swivellable-element part as viewed in the direction of the hinge axis, wherein, the displacement drive is arranged between the two swivellable-element-transmitter parts and comprises an adjusting spindle comprising a first threaded region comprising a right-hand thread and a second threaded region comprising a left-hand thread, the right-hand thread and the left-hand thread being configured to engage with the spindle nut arranged on or connected to each of the two swivellable-element-transmitter parts.

18. The device as recited in claim 1, wherein the wall-transmitter part and the swivellable-element-transmitter part each comprise induction coils.

19. The device as recited in claim 1, wherein at least one of the wall-transmitter part and the swivellable-element-transmitter part comprise a housing configured to shield electric fields or magnetic fields.

20. The device as recited in claim 1, further comprising an anti-twist part arranged in the wall part or in the swivellable-element part, the anti-twist part being configured to prevent a twisting of the wall-transmitter part or the swivellable-element-transmitter part.

21. The device as recited in claim 20, wherein the anti-twist part comprises a protrusion arranged on the wall-transmitter part, the protrusion being arranged so as to project into an indentation provided on swivellable-element part, or the anti-twist part comprises a protrusion arranged on the swivellable-element-transmitter part, the protrusion being arranged so as to project into an indentation provided on the wall part.

22. The device as recited in claim 21, wherein the wall-transmitter part or the swivellable-element-transmitter part comprises connection cables, and the protrusion comprises a channel configured to have the connection cables pass therethrough.

23. The device as recited in claim 21, wherein the indentation comprises delimitation surfaces which run substantially perpendicular to the hinge axis so as to form adjustment path delimitations for the wall-transmitter part or for the swivellable-element-transmitter part.

* * * * *